US005645222A

United States Patent [19]

Chih

[11] Patent Number: 5,645,222

[45] Date of Patent: Jul. 8, 1997

[54] SPRAY-PATTERN DIAL MOUNTING STRUCTURE FOR WATER SPRAYERS

[76] Inventor: E-Shun Chih, No. 5, Tian-Yang Section, Lu-Gung Town, Chang-Hau Hsien, Taiwan

[21] Appl. No.: 524,796

[22] Filed: Sep. 7, 1995

[51] Int. Cl.[6] ..... B05B 1/16

[52] U.S. Cl. ..... 239/394

[58] Field of Search ..... 239/391, 392, 239/394, 396, 436, 443, 525, 526, 537, 538, 540, 583

[56] References Cited

U.S. PATENT DOCUMENTS 5,232,162 8/1993 Chih ..... 239/394

*Primary Examiner*—Andres Kashnikow
*Assistant Examiner*—Robin O. Evans
*Attorney, Agent, or Firm*—Bacon & Thomas

[57] ABSTRACT

A spray-pattern dial mounting structure including a spray-pattern dial connected to the main body of a water spray, and a partition plate mounted within the spray-pattern dial, wherein the partition plate has a recessed portion at the front side and a plurality of longitudinal troughs at the recessed portion respectively connected to the nozzles on the spray-pattern dial, the recessed portion defining with the spray-pattern dial a water accumulation chamber for accumulating water from the water sprayer for permitting accumulated water to be further forced by water pressure out of radial lines of pores on the spray-pattern dial.

2 Claims, 4 Drawing Sheets

SPRAY-PATTERN DIAL MOUNTING STRUCTURE FOR WATER SPRAYERS

BACKGROUND OF THE INVENTION

The present invention relates to water sprayers, and relates more particularly to a spray-pattern dial mounting structure for water sprayers which eliminates the drawbacks of U.S. patent application Ser. No. 07/813,009, entitled "the structure of an adjustable spray cup of a water sprayer", now Pat. No. 5,232,162.

U.S. patent application Ser. No. 07/813,009, now U.S. Pat. No. 5,232,162 which was an invention of the present inventor, discloses an improvement in the structure of an adjustable spray cup of a water sprayer, in which the nozzles (261) which are arranged circularly around the spray cup (26) is extended inwardly and has a suitable length of wall surface, the inner wall surface of the opening rim of the spray cup (26) has a plurality of inwardly protruded lock walls (262) spaced equiangularly, and a plurality of locating slots (263); the connector (27) is provided with a conduit (271) which forms a valve opening (272) at a suitable position with a reduced diameter, a partition board (274), a water outlet (273) extended sideways from the central line to one side of the partition board (274), the partition board (274) being provided with a packing ring groove (275) for mounting a packing ring (276) and a locating seat (276) at the bottom to accommodate a locating block (277) and a spring (278); the main body (21) comprises a spray cup assembling seat (211) and an embedding ring (212) for mounting the spray cup (26). When assembled, an annular water chamber is defined between the partition board (274) of the connector (274) and the spray cup (26). However, the area of the packing ring (276) must be bigger than diameter of the extension wall of the nozzles (261). Because the packing ring (276) is made from flexible rubber, it tends to be deformed by water pressure and forced out of place, and therefore a water leakage tends to occur. Furthermore, because a water sealing ring is mounted between the partition board (274) of the connector (27) and the spray cup (26), the water sealing ring gives a resistance to the spray cup (26) when the spray cup (26) is rotated to change the spray pattern. Therefore, much effort is needed to adjust the spray pattern.

SUMMARY OF THE INVENTION

The present invention has been accomplished to provide a spray-pattern dial mounting structure for water sprayers which eliminates the aforesaid drawbacks. According to the preferred embodiment of the present invention, the partition plate is separately prepared and then mounted within the spray-pattern dial at the back side, having a recessed portion at the front side and a plurality of longitudinal troughs at the recessed portion respectively connected to the nozzles on the spray-pattern dial. The recessed portion of the partition plate defines with the spray-pattern dial a water accumulation chamber for accumulating water from the water sprayer for permitting accumulated water to be further forced by water pressure out of radial lines of pores on the spray-pattern dial.

DETAILED DESCRIPTION OF THE PREFERRED EMBODIMENT

Figure 1:
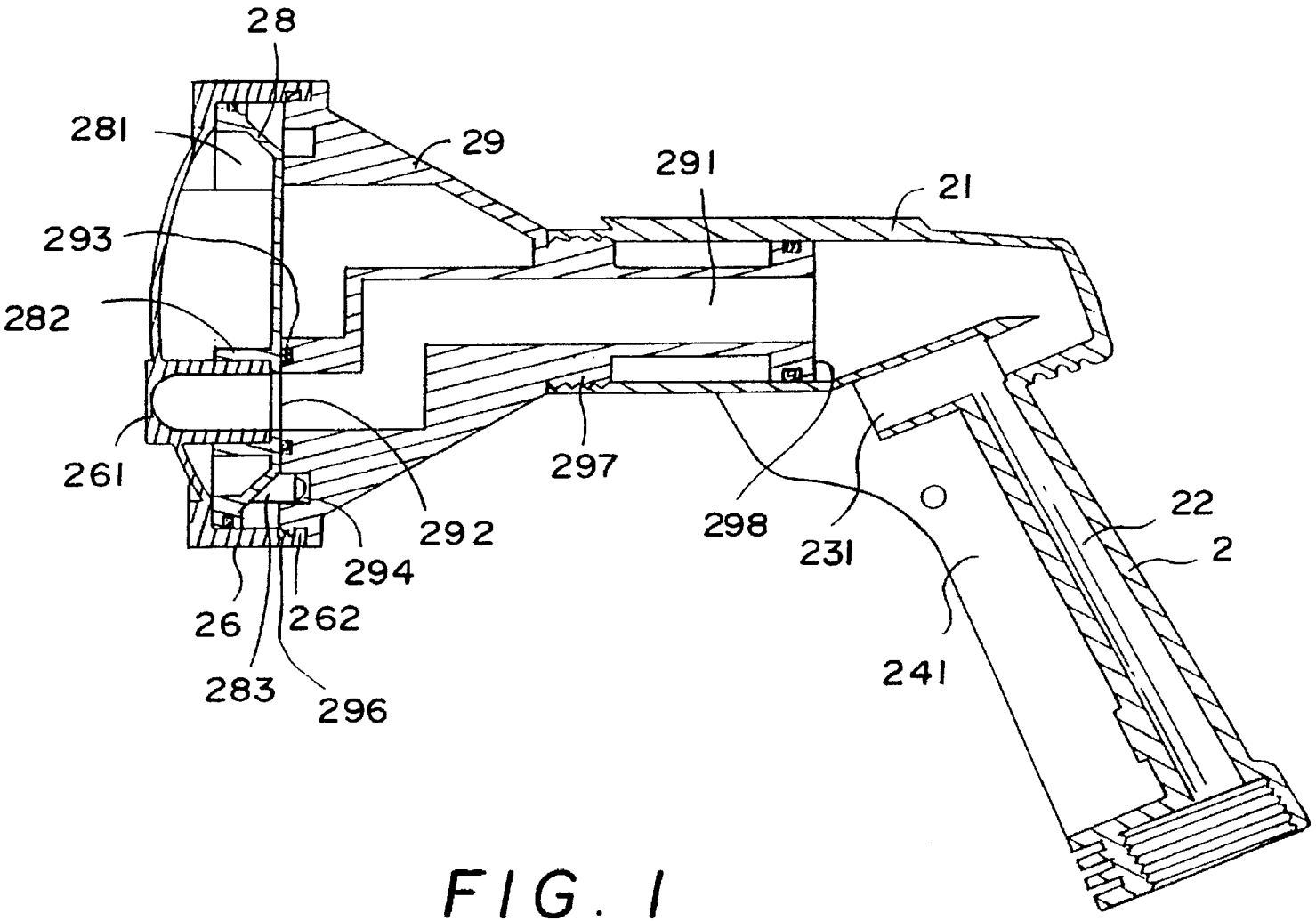
FIG. 1 is a sectional assembly view of a water spray gun according to the present invention.

Referring to FIG. 1, the main body 21 of the water spray gun has a bottom end integrally connected to a handle 2. The handle 2 defines a water passage 22, a valve stem mounting space 231 at the top end of the water passage 22 adjacent to the main body 21 for mounting a valve stem, and a trigger mounting space 241 for mounting a trigger. A spray-pattern dial 26 is connected to the main body 21 by a connector 29. An independent partition plate 28 is mounted between the connector 29 and the spray-pattern dial 26.

Figure 3:
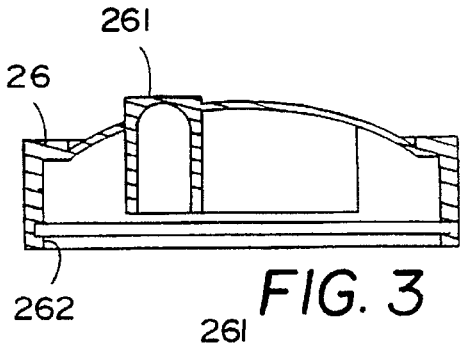
FIG. 3 is a sectional elevation of the spray-pattern dial shown in FIG. 2.
Figure 2:
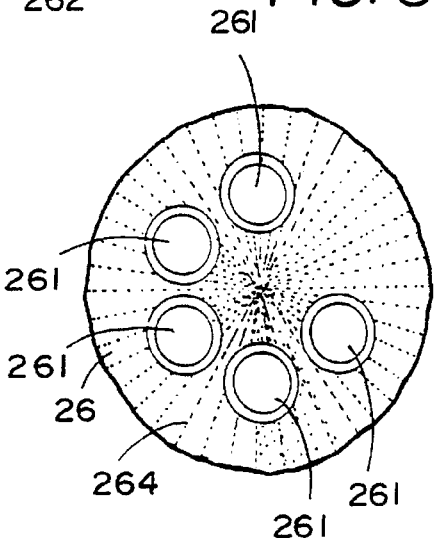
FIG. 2 is a front view of a spray-pattern dial according to the present invention.

Referring to FIGS. 2 and 3, the spray-pattern dial (the so-called spray cup) 26 comprises a plurality of nozzles 261 spaced around the center, a plurality of inwardly protruded and equiangularly spaced lock walls 262, and radial lines of pores 264 over the whole area of the front side.

Figure 6:
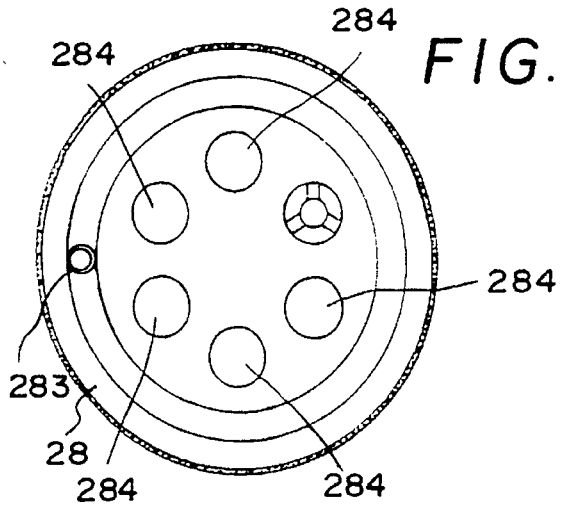
FIG. 6 is a back view of the partition plate shown in FIG. 4.
Figure 5:
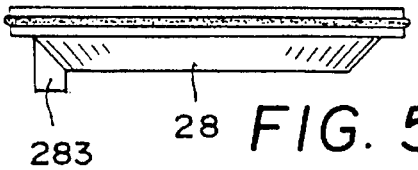
FIG. 5 is a side view of the partition plate shown in FIG. 4.
Figure 4:
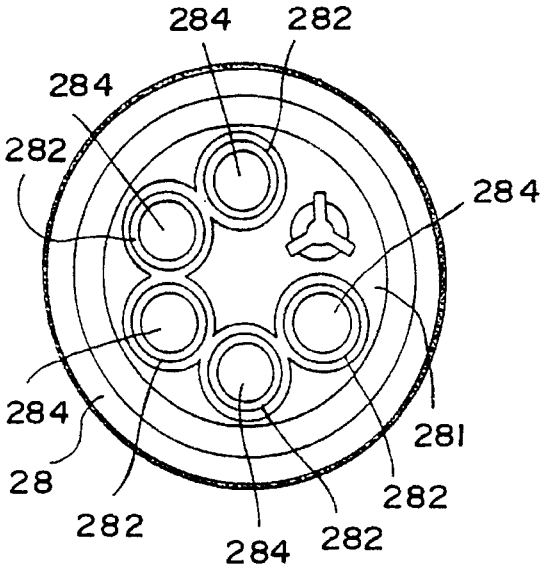
FIG. 4 is a front view of a partition plate according to the present invention.

Referring to FIGS. 4, 5, and 6, the partition plate 28 comprises a recessed portion 281 at one side, a plurality of longitudinal troughs 282 at the recessed portion 281 corresponding to the nozzles 261 of the spray-pattern dial 26, a plurality of water holes 284 respectively communicating the longitudinal troughs 282, a plurality of bottom locating rods 283 respectively fastened to the connector 29 and supported thereon by spring means (not shown). The diameter of the longitudinal troughs 282 is approximately equal to that of the nozzles 261.

Figure 7B:
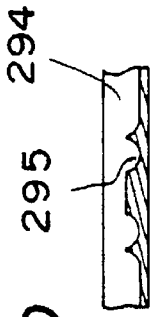
FIG. 7*b* is a sectional view taken along line 7*b*-7*b* of FIG. 7*a*.
Figure 7A:
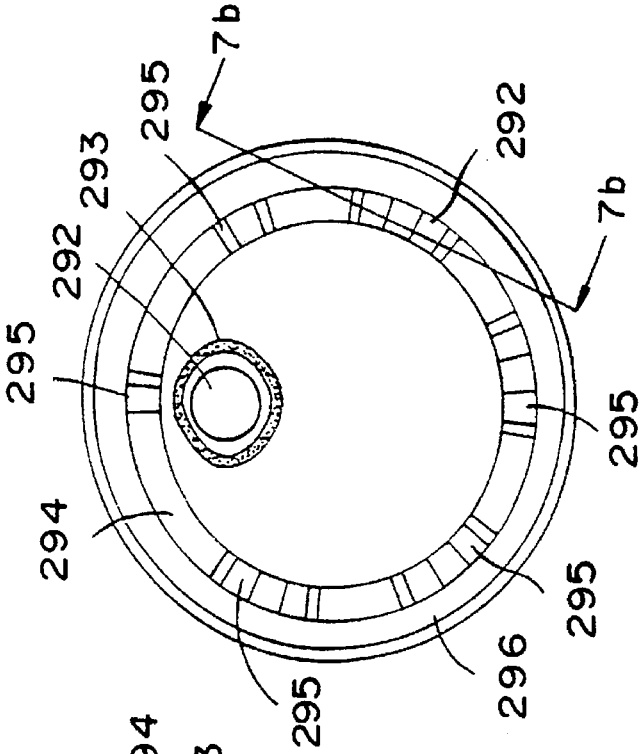
FIG. 7*a* is a front view of a connector according to the present invention.
Figure 8:
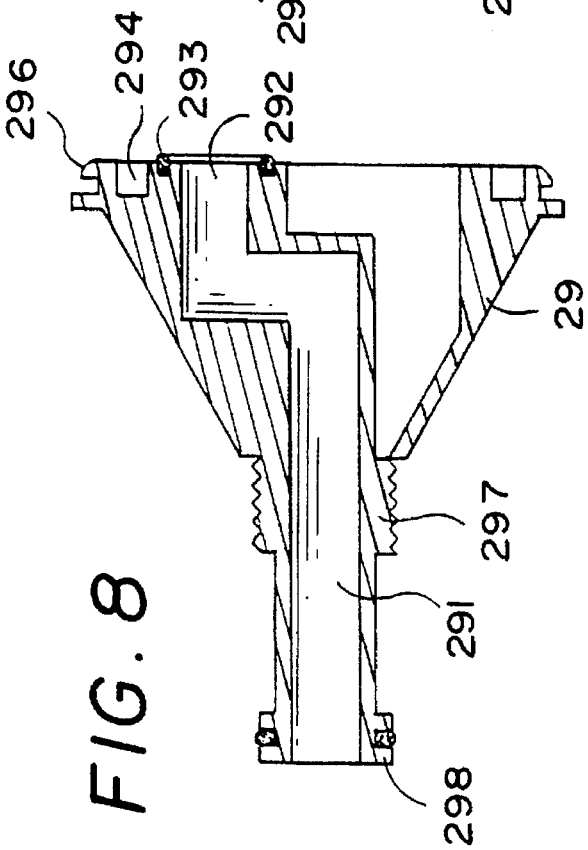
FIG. 8 is a a longitudinal view in section of the connector shown in FIG. 7A.

Referring to FIGS. 7 and 8, the connector 29 comprises a longitudinal water passage 291 in communication with the water passage 22 of the handle 2, a water outlet 292 at the front side at an offset position for guiding water from the water passage 291 to the spray-pattern dial 26, an oval water sealing ring 293 mounted around the water outlet 292, an annular guide groove 294 at the front side around the border, a plurality of locating grooves 295 corresponding to the nozzles 261, an outward locating flange 296 around the front end, an outer thread 297 in the middle, and a water seal ring 298 mounted around the rear end.

The assembly process of the present invention is simple and outlined hereinafter with reference to FIG. 1 again, the connector 29 is shaped like a cathode-ray-tube. Before threading the outer thread 297 of the connector 29 into the main body 21, the outer thread 297 of the connector 29 is coated with a layer of glue. Therefore, the connection between the connector 29 and the main body 21 is firmly secured when the glue is hardened. When the connector 29 and the main body 21 are fastened together, the water passage 291 of the connector 29 is disposed in communication with the water passage 22 of the handle 2. The partition plate 28 is fastened to the back side of the spray-pattern dial 26 by glue and sealed by a water sealing ring.

When the partition plate 28 and the spray-pattern dial 26 are fastened together, the longitudinal troughs 282 of the partition plate 28 are respectively connected to the nozzles 261 of the spray-pattern dial 26. When the partition plate 28 and the spray-pattern dial 26 are assembled, the spray-pattern dial 26 is fastened to the connector 29 by hooking up the lock walls 262 of the spray-pattern dial 26 with the outward flange 296 of the connector 29, permitting the locating rod 283 to be inserted into the annular guide groove 294 of the connector 29. When installed, the spray-pattern dial 26 can be rotated relative to the connector 29 to change the spray pattern.

Figure 9:
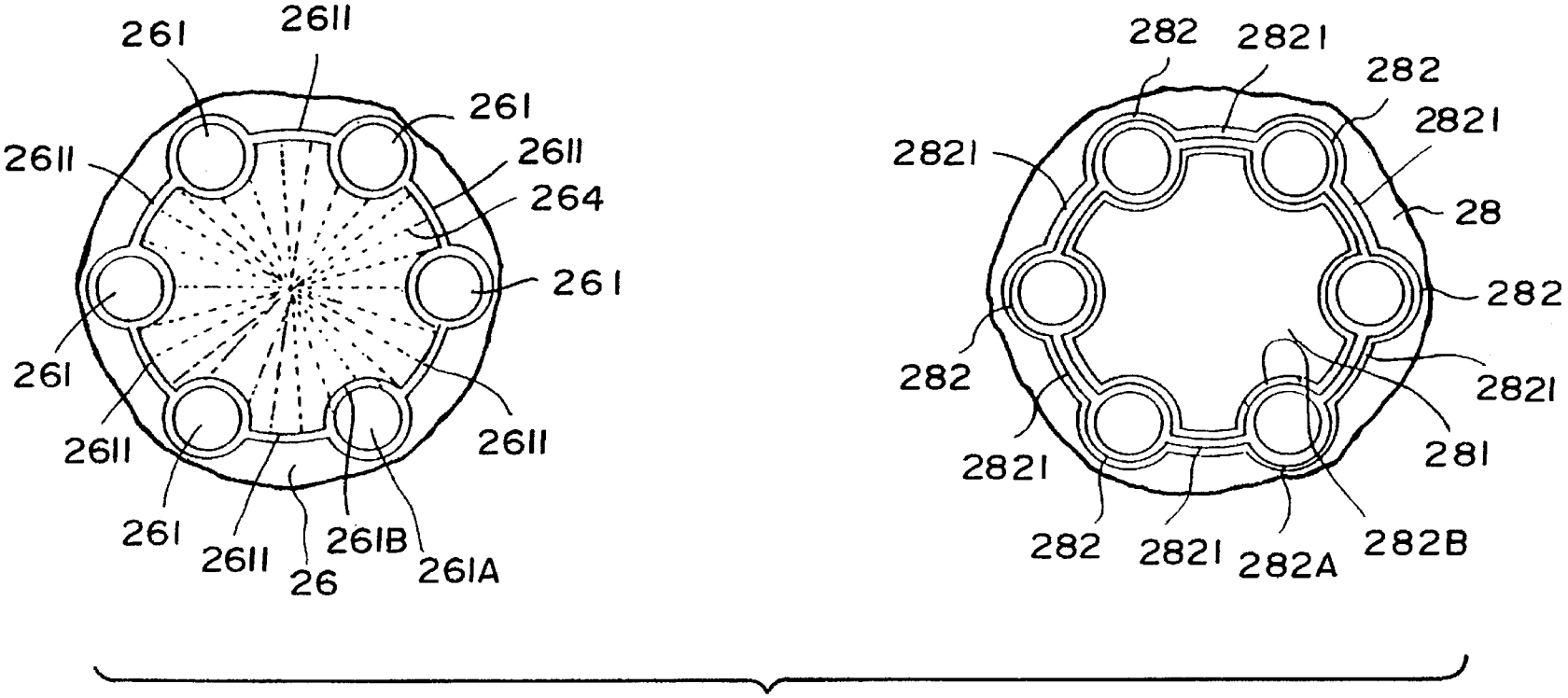
FIG. 9 shows an alternate form of the spray-pattern dial and the partition plate according to the present invention.

FIG. 9 shows an alternate form of the spray-pattern dial 26 and an alternate form of the partition plate 28. As illustrated, the nozzles 261 of the spray-pattern dial 26 are respectively connected with one another by ribs 2611, the radial lines of pores 264 are defined within the ribs 2611, and one nozzle 261A is made with a water guide notch 261B. The longitudinal troughs 282 of the partition plate 28 are respectively connected with one another by ribs 2821, and one longitudinal trough 282A is made with a water guide notch 282B. When the partition plate 28 and the spray-pattern dial 26 are assembled, water from the water outlet 292 of the connector 29 can be guided through the water guide notch 261B into the space defined within the ribs 2611 and then forced out of the spray-pattern dial 26 through the radial lines of pores 264.

It is to be understood that the drawings are designed for purposes of illustration only, and are not intended as a definition of the limits and scope of the invention disclosed.

I claim:

1. A spray-pattern dial mounting structure comprising a spray-pattern dial having a plurality of nozzles and radial lines of pores, a partition plate mounted within said spray-pattern dial, and a connector to connect said spray-pattern dial to the body of a water sprayer and to guide water from the body of said water sprayer to said spray-pattern dial through said partition plate, permitting water to be further forced out of said spray-pattern dial through said radial lines of pores or said nozzles, wherein said partition plate comprises a recessed portion at one side, and a plurality of longitudinal troughs at said recessed portion respectively connected to the nozzles of said spray-pattern dial, said recessed portion defining with said spray-pattern dial a water accumulation chamber for accumulating water from said water sprayer for permitting accumulated water to be further forced by water pressure out of the radial lines of pores of said spray-pattern dial.

2. The spray-pattern dial mounting structure of claim 1 wherein the nozzles of said spray-pattern dial are respectively connected with one another by ribs; the longitudinal troughs of said partition plate are respectively connected with one another by ribs; the ribs of said spray-pattern dial are abutted against the ribs of said partition plate, defining a water accumulation chamber for accumulation of water and for permitting accumulated water to be further forced by water pressure out of the radial lines of pores of said spray-pattern dial.

* * * * *